US005465534A

United States Patent [19]

Mittag

[11] Patent Number: 5,465,534

[45] Date of Patent: Nov. 14, 1995

[54] FLOORING SUBSTRUCTURE

[75] Inventor: Douglas Mittag, Bollingbrook, Ill.

[73] Assignee: Equipto, Aurora, Ill.

[21] Appl. No.: 249,936

[22] Filed: May 26, 1994

[51] Int. Cl.[6] ..... E04F 15/024

[52] U.S. Cl. ..... 52/126.6; 52/126.7; 52/263; 52/480; 52/483.1; 52/508

[58] Field of Search ..... 52/126.1, 126.5, 52/126.6, 126.7, 263, 365, 480, 483.1, 508

[56] References Cited

U.S. PATENT DOCUMENTS

| | | | |
|---|---|---|---|
| Re. 16,416 | 9/1926 | Whittaker . | |
| 2,943,716 | 7/1960 | Babcock . | |
| 3,170,217 | 2/1965 | Williams | 52/483.1 X |
| 3,316,680 | 5/1967 | Chrastek | 52/126.6 |
| 3,402,517 | 9/1968 | Halfaker . | |
| 3,511,001 | 5/1970 | Morgan, Jr. . | |
| 3,540,175 | 11/1970 | Hawn | 52/126.6 |
| 3,640,036 | 2/1972 | Nakazawa et al. | 52/263 X |
| 3,789,557 | 2/1974 | Harvey . | |
| 3,811,237 | 5/1974 | Bettinger . | |
| 3,831,329 | 8/1974 | Lear | 52/126.6 |
| 3,899,857 | 8/1975 | Mochizuki . | |
| 3,924,370 | 12/1975 | Cauceglia et al. | 52/126.6 |
| 4,192,623 | 3/1980 | Borg | 52/126.5 X |
| 4,296,574 | 10/1981 | Stephens | 52/263 X |
| 4,404,780 | 9/1983 | Josephson | 52/126.5 X |
| 4,558,544 | 12/1985 | Albrecht et al. . | |
| 4,561,232 | 12/1985 | Gladden, Jr. et al. . | |
| 4,850,162 | 7/1989 | Albrecht . | |
| 4,922,670 | 5/1990 | Naka et al. | 52/126.6 |
| 5,192,123 | 3/1993 | Wallin . | |
| 5,345,779 | 9/1994 | Feeney | 52/126.1 X |
| 5,349,800 | 9/1994 | Peng | 52/483.1 X |
| 5,371,985 | 12/1994 | Suttles | 52/126.1 |

FOREIGN PATENT DOCUMENTS

| | | | |
|---|---|---|---|
| 1388095 | 12/1964 | France | 52/126.6 |
| 4228601 | 4/1993 | Germany | 52/126.1 |
| 3199570 | 8/1991 | Japan | 52/480 |
| 4166551 | 6/1992 | Japan | 52/480 |
| 6057923 | 3/1994 | Japan . | |
| 1011939 | 12/1965 | United Kingdom | 52/480 |
| 1527599 | 10/1978 | United Kingdom | 52/263 |
| 1555115 | 11/1979 | United Kingdom | 52/126.6 |
| 2185048 | 7/1987 | United Kingdom | 52/126.6 |
| 9119063 | 12/1991 | WIPO | 52/126.1 |

OTHER PUBLICATIONS

Floating Floors Inc., "Standard Architectural and Engineering Details and Specifications for Designing an Infinite Access Floating Floor", 1961 Elaflor Brochure 1959.

*Primary Examiner*—Carl O. Friedman
*Assistant Examiner*—Laura A. Saladino
*Attorney, Agent, or Firm*—Hill, Steadman & Simpson

[57] ABSTRACT

A flooring system is provided for elevating flooring panels above a subfloor, such as the subfloor of a computer room. The invention provides a flooring substructure which has a plurality of elongated tracks arranged parallel to one another. A plurality of brackets are securable against the tracks, and a plurality of channel members are secured to the brackets so that the channels are aligned perpendicularly to the tracks. The channels are configured for supporting the flooring panels. Adjustable leveling screws are threaded upwardly through the brackets to contact the subfloor and support the substructure.

20 Claims, 2 Drawing Sheets

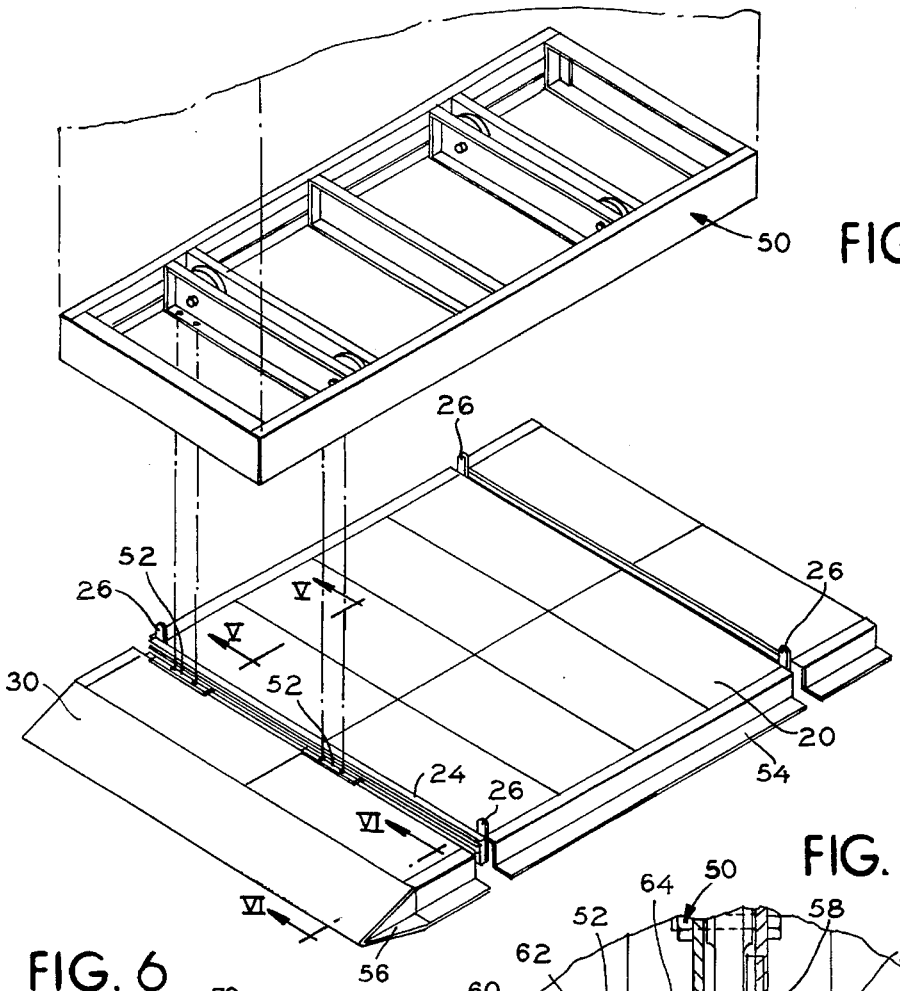
FIG. 4
FIG. 5
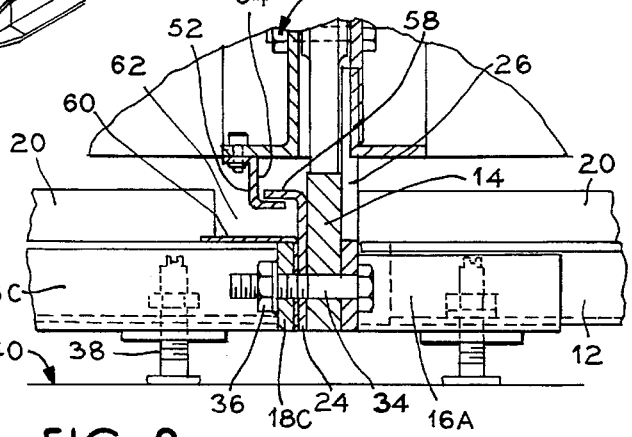
FIG. 6
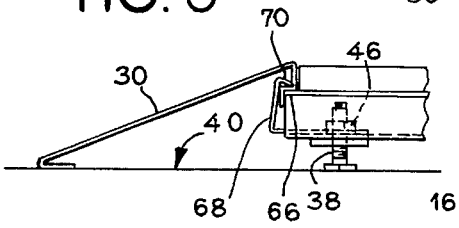
FIG. 3
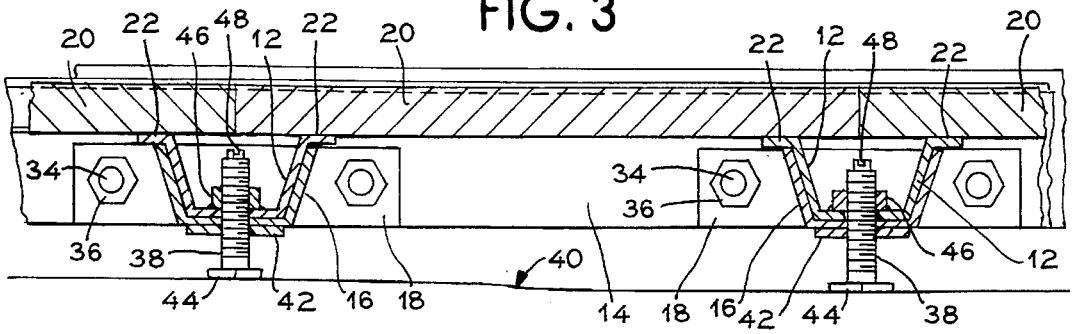

FLOORING SUBSTRUCTURE

BACKGROUND OF THE INVENTION

The present invention relates generally to elevated floors. More particularly, the invention relates to an improved flooring system including a substructure for supporting floor panels over a subfloor.

Elevated floor assemblies are known. Such assemblies generally have a substructure which supports floor panels over a subfloor, such as the floor of a building. This provides a useable space between the subfloor and the floor panels.

Elevated floors are often used in areas housing computers or other electronic equipment. An elevated floor is desirable in such an area so that associated cables and wiring can conveniently be disposed in the space under the floor panels. Also, pipes, HVAC ducts, etc. can be placed in that space as well. By configuring the floor panels to be removable, the space can be easily accessed for repair or installation of new items.

The subfloor of a building is usually substantially horizontal, but rarely imperfectly planar. In other words, a floor might have a slight grade, or a slight rolling contour. Even though such imperfections might be imperceptible from eyesight, it is desirable to provide adjustable footing on an elevated flooring system to provide adequate, even support contact between the substructure and the subfloor. It is known to provide an adjustable footing structure so that the raised flooring panels are held horizontally, and so that the substructure properly contacts the subfloor.

Prior art patents relating to elevated flooring assemblies include U.S. Pat. Nos. 4,850,162, 4,561,232, 4,558,554, 3,811,237 and 3,789,557. Many such traditional systems require complicated structures and can have a high number of parts. Furthermore, systems designed for high stability and strength and for providing a useable space under floor panels generally implement some sort of intermediate structure between leveling screws and the main structural components. Simpler systems can be flimsy.

Accordingly, a need exists for a flooring substructure that is stable, strong, simple in design, and has relatively few parts.

In an environment where a flooring substructure is used, there are often heavy pieces of equipment which can be accidentally overturned, such as computers or cabinets. Therefore, a need exists for a flooring substructure which includes a means for securing such heavy equipment to the flooring substructure.

SUMMARY OF THE INVENTION

The present invention provides an improved flooring system for supporting elevated panels over a subfloor. To this end, a flooring substructure is provided which has a plurality of elongated tracks. The elongated tracks are arranged parallel to one another. A plurality of brackets are provided. Each bracket has an end plate that is securable against one of said tracks. A plurality of elongated channel members are secured to said brackets so that said channel members are aligned perpendicularly to the tracks. A plurality of adjustable leveling screws are threaded into the brackets so that the screws can rest on a generally subfloor and hold the channel members horizontally above the subfloor.

In an embodiment, the tracks have ends, and can be arranged end-to-end so that end plates on the brackets overlap portions of two tracks.

In an embodiment, at least one of the brackets has an upwardly extending projection which extends above the flooring panels.

In an embodiment, a ramp is provided that is securable to end brackets. The ramp provides a sloped surface from the subfloor to the floor panels.

In an embodiment, the substructure further has end angles for covering a gap between the floor panels and the subfloor.

In an embodiment, the substructure further includes an anchor rail which is securable between the tracks and the brackets. The rail has a horizontal upper projection which is directed away from the track. The horizontal upper projection is configured to be substantially flush with an adjacent floor panel, but is separated from the floor panel by a gap. The rail also has a horizontal lower projection configured to be disposed over the bracket end plate. A cavity is defined between the upper projection and the lower projection such that an L-shaped prong can be inserted into the cavity for anchoring an object to the rail.

An advantage of the present invention is that it provides a flooring substructure that is simple in design relative to traditional flooring systems.

Another advantage of the present invention is that it provides an improved means for leveling an elevated flooring assembly.

A further advantage of the present invention is that it provides a means for anchoring objects.

Yet another advantage of the present invention is that is provides adequate space and access to a space underneath elevated floor panels for wiring, etc.

Additional features and advantages of the present invention are described in, and will be apparent from, the detailed description of the presently preferred embodiments and from the drawings.

BRIEF DESCRIPTION OF THE DRAWINGS

FIG. 3 illustrates a partial sectional view taken generally along line III—III of FIG. 1.

FIG. 4 illustrates a perspective view of a flooring substructure and an associated interlocking carriage assembly.

FIG. 5 illustrates a partial sectional view taken generally along line V—V of FIG. 4.

FIG. 6 illustrates a partial sectional view taken generally along line VI—VI of FIG. 4.

DETAILED DESCRIPTION OF THE PRESENTLY PREFERRED EMBODIMENTS

Figures 1, 2:
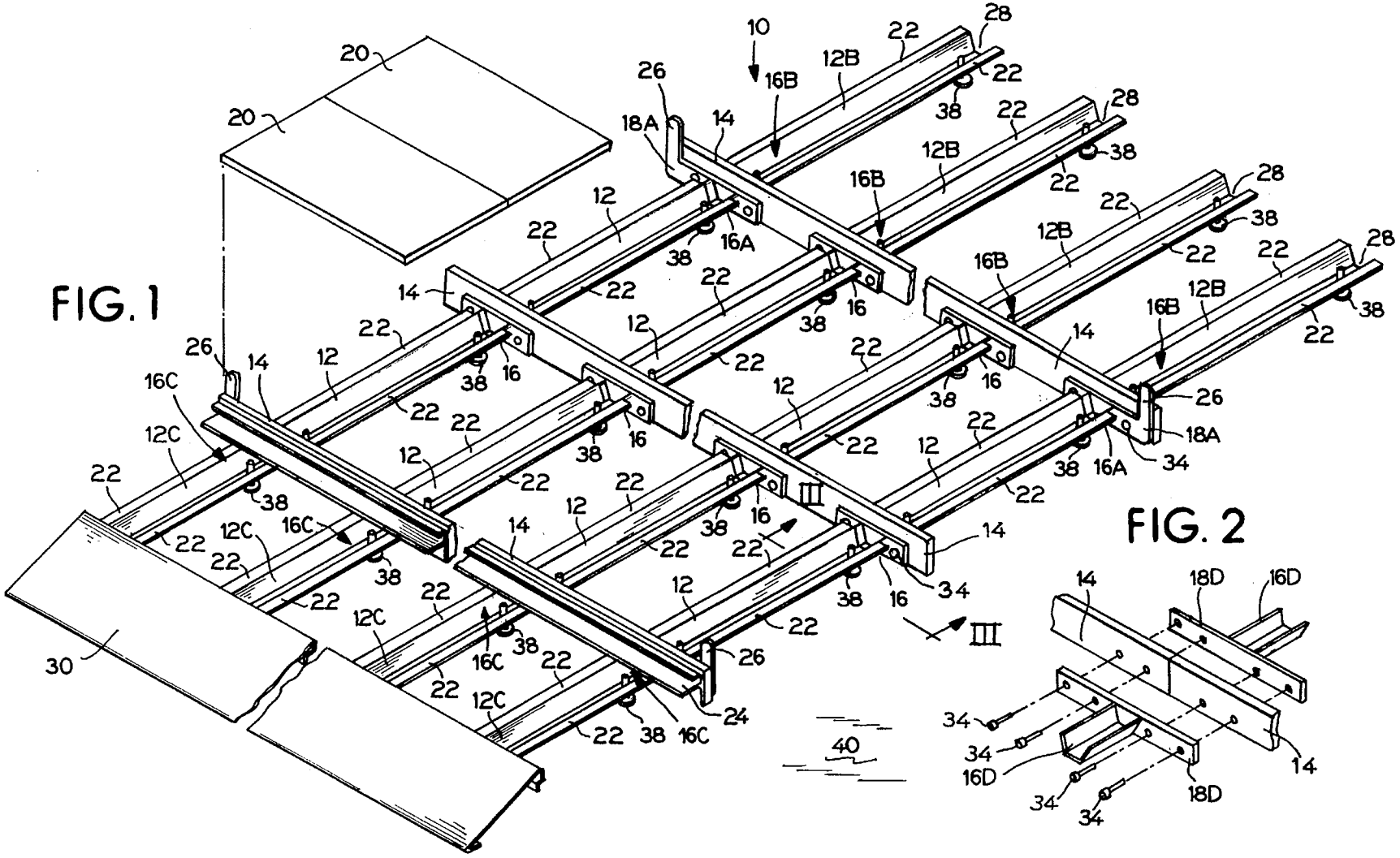
FIG. 1 illustrates a perspective view of the flooring system of the present invention.
FIG. 2 illustrates a partial exploded view of a connection between perpendicular tracks and channel members of the present invention.

FIG. 1 generally illustrates a flooring substructure 10 according to the present invention. The substructure 10 includes a plurality of channel members 12 aligned parallel to one another.

A plurality of elongated tracks 14 are also provided. The tracks 14 are arranged parallel to one another and perpendicularly to the channel members 12. A generally T-shaped bracket 16 is secured at each end of each channel member 12 adjacent to one of the tracks 14. Each bracket 16 has an end plate 18. Each track 14 is bolted to end plates 18 of brackets 16 between sets of channel members 12 which are generally aligned end-to-end.

The channel members 12 are configured to support flooring panels 20 in a horizontal fashion. The flooring panels 20 rest on upper edges 22 of each channel member 12. The tracks 14 are dimensioned so that an upper surface of each track 14 is substantially flush with adjacently supported flooring panels 20. The flooring panels 20 are preferably made of plywood, however some other rigid material could be used.

Optionally, an elongated rail known as a tip stop angle 24 can be provided adjacently to one or more tracks 14. The tip stop angle 24 is configured to cooperatively engage with and provide an anchoring means for objects to rest on the flooring panels 20, as described below. The tip stop angle 24 permits the subject matter of U.S. Pat. No. 5,192,123, assigned to Aurora Equipment Co. and incorporated herein by reference, to be used in combination with the flooring substructure disclosed herein.

Preferably, a specially configured bracket 16A is used for connection adjacent an end of a tip stop angle 24, instead of one of the straight-ended brackets 16. The bracket 16A has an upwardly extending projection 26, which extends above the level the flooring panels 20. As assembled in a room, the bracket 16A is preferably adjacent to a wall of the room.

The bracket 16A is particularly useful in guiding a heavy object which is being placed for engagement with the tip stop angle 24. However, a bracket 16A can be implemented into the substructure 10 even if not in conjunction with a tip stop angle 24. The projection 26 on the bracket 16A can be used for positioning and aligning cabinetry, computers, shelves, or other items. A bracket 16A can be configured for left or right positioning. A plastic cover can be slipped over the projection 26.

As shown, brackets 16B are positioned at the end of the substructure. The brackets 16B are preferably integral to a channel member 12B, and have a free end 28 which is not connected to a track 14. The channel member 12B of the bracket 16B can be welded to a end plate 18B of the bracket 16B. The free end 28 of each bracket 16B is preferably positioned against a wall of the room.

Similarly, brackets 16C are positioned at an end of the substructure 10 at which an optional ramp 30 can be connected. The brackets 16C are integral to a channel member 12C. The channel member 12C can be welded to an end plate 18C of the bracket 16C. The ramp 30 is secured to a free end 28 (FIG. 6) of each bracket 16C. The ramp 30 provides a sloped surface extending from a subfloor 40 to a level flush with supported floor panels 20.

The tracks 14 are bolted between two opposing brackets 16, 16A, 16B, or 16C. The end plate 18, 18A, 18B, 18C of each respective bracket 16, 16A, 16B, 16C preferably has two bolt holes through which bolts 34 are disposed through the track 14. However, in an assembly where the substructure 10 is assembled to a width greater than the length of one track 14, multiple tracks 14 must be connected end-to-end. FIG. 2 illustrates a splicing together of such end-to-end tracks 14. FIG. 2 illustrates opposing brackets 16D, each of which has a longer end plate 18D configured to accommodate four bolts 34. Ends of two tracks 14 are secured between the T-shaped ends of the brackets 16D so that the end plates 18D overlap both tracks 14.

In an embodiment, it has been found that each bolt 34 can be a #16 hex head bolt, ⅜"×1¾", being tightened with a #16 ⅜" hex flange nut.

As illustrated in FIG. 1, A plurality of leveling screws 38 are threaded through the brackets 16, 16A, 16B, 16C, 16D for supporting the substructure 10 on the generally planar subfloor 40.

FIG. 3 illustrates details of the connection of the leveling screws 38 to the substructure 10. Each bracket 16, 16A, 16B, 16C, 16D has a leveling screw 38 is threaded through it. Furthermore, the leveling screws are threaded through the associated bracket 16, 16A, 16B, 16C, 16D that each channel member 12, 12B, 12C is supported over the subfloor 40 by two leveling screws 38. A stiffening plate 42 is preferably provided on each bracket 16, 16A, 16B, 16C, 16D to provide sufficient strength and threaded area to support the subfloor 10. Each leveling screw 38 has a head 44 which contacts the subfloor 40.

On the each bracket 16, 16A, 16D a hex nut 46 is tightened onto the leveling screw 38 to secure the adjacent channel member 12 to the bracket 16, 16A, 16D and to lock the leveling screw 38 in a desired position. Because the channel members 12B and 12C are preferably integral to the brackets 16B and 16C, respectively, a hex nut 46 is not necessary to secure those components. However, a hex nut 46 is preferably used on the adjusting screws 38 through channel members 12B and 12C to lock the adjusting screw 38 in a desired position. The leveling screws 38 extend vertically through the channel members 12, 12B, 12C. Each leveling screw 38 is vertically adjustable by rotation. Preferably, a screwdriver slot 48 is disposed in the top of each leveling screw 38 so that the screw 38 can be easily rotated from above. In an embodiment, it has been found that each leveling screw can be a #16 ⅜"×1½" bolt having the head 44. Each associated hex nut 46 can be a #16 ⅜" nut.

FIG. 3 also illustrates the supporting contact between channel members 12 and the flooring panels 20. Preferably, the flooring panels 20 are aligned so that edges of the flooring panels meet between the upper edges 22 of a channel member 12, 12B, 12C.

Turning to FIG. 4, a carriage 50 is illustrated which is configured to be engaged by the optional tip stop angle 24. The carriage 50 can serve as a base for an object such as a cabinet or a computer to supported on the flooring panels 20. At least one ledge member 52, which is shaped to be engaged by the tip stop angle 24, is secured to the carriage 50. Alternatively, the ledge member 52 could be attached to an object directly, without the carriage 50. Also, the brackets 16A are preferably placed so that the projections 26 can contact the carriage 50, holding it in position.

Also illustrated in FIG. 4 are end cap angles 54 configured to be secured to the flooring panels, extending to the subfloor 40. The end cap angles 54 can be a single Z-shaped piece, or preferably a pair of L-shaped pieces, one secured to the flooring panels and one to the floor. A ramp end filler angle 56 can also be provided for covering a gap between an end of the ramp 30 and the subfloor 40.

Detail of the engagement between the ledge member and the tip stop angle 24 is illustrated in FIG. 5. The tip stop angle 24 has a horizontal upper projection 58 which is directed away from the track 14. The upper projection 58 is configured to be substantially flush with adjacent floor panels 20. The tip stop angle 24 also has a horizontal lower projection 60 configured to be disposed over the adjacent bracket 16 or 16D. There is a gap between the horizontal upper projection 58 and an adjacent floor panel 20 to provide a cavity 62. The ledge member 52 has an L-shaped prong 64 that can be inserted into the cavity 62 and engaged with the horizontal upper projection 58. This engagement anchors the ledge member 52, and thus the carriage 50, to the substructure 10.

FIG. 6 illustrates detail of the ramp. The ramp has an upper end which is longitudinally bent downward and having an inwardly projecting shelf 66. The shelf 66 rests on the channel members 12C across the upper edges 22 thereof. A ramp clamp 68 is secured between the channel member 12C and the nut 46 on the leveling screw 38 proximal thereto. The ramp clamp 68 extends out of the channel member 12C, curving upward and terminating in a lip 70 which holds the ramp 30 in position against the channel member 12C.

Preferably, the substructure 10 is assembled starting with the brackets 16B against a wall of the room. Then, all channel members 12 are secured to appropriate brackets 16, 16A, 16D and tracks 14. Starting with the leveling screws 38 adjusted maximally downward, so that the substructure is high, the leveling screws are adjusted to let the floor down, starting with the leveling screw 38 at the highest point on the subfloor 40, until all of the leveling screws 38 are in contact with the floor 40 and the tracks 14 and channel members 12, 12B, 12C are level.

In an embodiment, the leveling screws can be anchored to the floor with an anchor strip disposed over the leveling screw head 44. A hole is drilled into the subfloor 40 through the anchor strip. A plastic plug is then tapped into the hole in the subfloor 40. The plug is essentially a plastic tube having grips disposed on an inner wall thereof. The anchor is then secured by screwing a sheet metal screw through the anchor and into the plug. The hole in the subfloor is preferably 5/16" diameter and 1½" deep. The metal screw is preferably a #14 1" metal screw.

Preferably, the bottom edge of the ramp 30 is similarly secured to the floor using screws into floor anchors.

Finally, the flooring panels 20 are placed atop the substructure so that they rest on the channel members 12, 12B, 12C. Preferably, the flooring panels 20 are secured to the channel members 12, 12B, 12C by screws. In an embodiment, it has been found that a suitable screw is a #10 1⅝" TEK bugle head screw.

It should be understood that various changes and modifications to the presently preferred embodiments described herein will be apparent to those skilled in the art. Such changes and modifications may be made without departing from the spirit and scope of the present invention and without diminishing its intended advantages. It is, therefore, intended that such changes and modifications be covered by the appended claims.

What is claimed is:

1. A flooring substructure comprising:

a plurality of elongated tracks arranged parallel to one another, each track having external, oppositely-facing longitudinal sides;

a plurality of brackets, each bracket having an end plate securable against one of said sides;

a plurality of elongated channel members secured to said brackets so that said channel members are arranged perpendicularly to said tracks, said channel members configured for supporting floor panels;

a plurality of floor panels supported by said channel members; and a plurality of adjustable leveling screws threaded into said brackets so that said screws rest on a generally planar subfloor to hold said channel members horizontally above said subfloor.

2. A flooring substructure according to claim 1 wherein said tracks have ends and said tracks are arrangeable end-to-end so that said end plates overlap portions of two said tracks.

3. A flooring substructure according to claim 1 wherein at least one of said brackets has an upwardly extending projection which extends above said floor panels.

4. A flooring substructure according to claim 1 further comprising end brackets having an integral channel member secured to one end plate securable against one of said tracks.

5. A flooring substructure according to claim 4 further comprising a ramp that is securable to said end brackets to provide a sloped surface from said subfloor to said floor panels.

6. A flooring substructure according to claim 1 further comprising end angles for covering a gap between said floor panels and said subfloor.

7. A flooring substructure comprising:

a plurality of elongated tracks arranged parallel to one another;

a plurality of brackets, each bracket having an end plate securable against one of said tracks;

a plurality of elongated channel members secured to said brackets so that said channel members are arranged perpendicularly to said tracks, said channel members configured for supporting floor panels;

a plurality of floor panels supported by said channel members;

a plurality of adjustable leveling screws threaded into said brackets so that said screws rest on a generally planar subfloor to hold said channel members horizontally above said subfloor; and an anchor rail securable between one of said tracks and adjacent said brackets; said rail comprising:

a horizontal upper projection which is directed away from said track and configured to be substantially flush with an adjacent floor panel, but separated with said floor panel by a gap; and a horizontal lower projection configured to be disposed over said adjacent brackets;

wherein a cavity is defined between said upper projection and said lower projection such that a ledge member is engageable with said anchor rail for anchoring an object to said rail.

8. A flooring system comprising:

a plurality of brackets;

a plurality of elongated, parallel tracks securable between pairs of said brackets, the brackets of each pair being secured together against opposite sides of the respective track, compressing the track between the brackets in a sandwich-like manner;

a plurality of elongated channel members secured to said brackets so that said channel members are aligned perpendicularly to said tracks and wherein said channel members are configured to support a plurality of floor panels;

a plurality of floor panels supported by said channel members; and a plurality of leveling screws threaded through said brackets for contacting a subfloor.

9. A flooring system according to claim 8 wherein said tracks have ends and said tracks are arrangeable end-to-end so that said brackets overlap portions of two said tracks.

10. A flooring system according to claim 8 wherein said brackets have an upwardly extending portion which extends above said floor panels.

11. A flooring system according to claim 8 further comprising a ramp that is securable to said channel members to provide a sloped surface from said subfloor to said floor panels.

12. A flooring system according to claim 8 further comprising end angles for covering a gap between said floor panels and said subfloor.

13. A flooring system comprising:

a plurality of brackets;

a plurality of elongated, parallel tracks securable between pairs of said brackets;

a plurality of elongated channel members secured to said brackets so that said channel members are aligned perpendicularly to said tracks and wherein said channel members are configured to support a plurality of floor panels;

a plurality of floor panels supported by said channel members;

a plurality of leveling screws threaded through said brackets for contacting a subfloor;

a ramp that is securable to said channel members to provide a sloped surface from said subfloor to said floor panels; and at least one ramp clamp secured to at least one channel member and configured to clip under a lip of said ramp.

14. A flooring system comprising:

a plurality of brackets;

a plurality of elongated, parallel tracks securable between pairs of said brackets;

a plurality of elongated channel members secured to said brackets so that said channel members are aligned perpendicularly to said tracks and wherein said channel members are configured to support a plurality of floor panels;

a plurality of floor panels support by said channel members;

a plurality of leveling screws threaded through said brackets for contacting a subfloor; and an anchor rail securable between one of said tracks and at least one of said brackets, said rail comprising:

a horizontal upper projection which is directed away from said track and configured to be substantially flush with an adjacent floor panel, but separated from said floor panel by a gap;

a horizontal lower projection configured to be disposed over said bracket;

wherein a cavity is defined between said upper projection and said lower projection such that a prong can be inserted into said cavity for engaging said rail for anchoring an object to said rail.

15. A flooring substructure comprising:

a plurality of elongated, parallel tracks;

a plurality of elongated channel members securable perpendicularly between said tracks, said channel members having generally T-shaped end brackets which are boltable to said tracks; and a plurality of leveling screws connected to said channel members;

wherein said substructure supports flooring panels in a horizontal position.

16. A flooring substructure according to claim 15 wherein said tracks can be arranged end-to-end so that said T-shaped end brackets overlap portions of two said end-to-end tracks.

17. A flooring substructure according to claim 15 wherein said T-shaped end brackets have an upwardly extending projection which extends above said floor panels.

18. A flooring substructure according to claim 15 wherein said substructure supports said flooring panels above a generally horizontal surface, said substructure further comprising a ramp that is securable to said channels to provide a slope surface from said horizontal surface to said floor panels.

19. A flooring substructure according to claim 15 wherein said substructure supports said flooring panels above a generally horizontal surface, said substructure further comprising end angles for covering a gap between said floor panels and said horizontal surface.

20. A flooring substructure according to claim 15 further consisting of an anchor rail securable between one of said tracks and at least one of said brackets, said rail comprising:

a horizontal upper projection which is directed away from said track and configured to be substantially flush with an adjacent floor panel, but separated from said floor panel by a gap; and a horizontal lower projection configured to be disposed over said bracket;

wherein a cavity is defined between said upper projection and said lower projection such that a prong can be inserted into said cavity for engaging said rail for anchoring an object to said rail.

* * * * *